US007798197B2

(12) United States Patent
Gutierrez

(10) Patent No.: US 7,798,197 B2
(45) Date of Patent: Sep. 21, 2010

(54) SELF-ACTUATED, SELF-RELEASE RAFTER LOCK MECHANISM

(75) Inventor: Roberto Gutierrez, El Paso, TX (US)

(73) Assignee: Dometic, LLC, Elkhart, IN (US)

( * ) Notice: Subject to any disclaimer, the term of this patent is extended or adjusted under 35 U.S.C. 154(b) by 678 days.

(21) Appl. No.: 11/546,166

(22) Filed: Oct. 11, 2006

(65) Prior Publication Data

US 2008/0087384 A1 Apr. 17, 2008

(51) Int. Cl.
*E04F 10/01* (2006.01)

(52) U.S. Cl. ..... 160/67; 160/71

(58) Field of Classification Search ..... 160/45, 160/69, 71, 66, 67, 68, 78, 79, 22, 72, 74, 160/73, 75, 80, 82, DIG. 4; 403/61, 65, 80, 403/82, 91, 95, 109.2; 135/88.1, 88.12, 117
See application file for complete search history.

(56) References Cited

U.S. PATENT DOCUMENTS 4,253,689 A * 3/1981 McKee ..... 292/338
4,658,877 A * 4/1987 Quinn ..... 160/46
5,172,743 A 12/1992 Wallace et al.
5,472,007 A 12/1995 Malott
5,560,412 A * 10/1996 Murray ..... 160/67
5,562,143 A 10/1996 Oberstadt
5,732,756 A 3/1998 Malott
5,752,556 A 5/1998 Steadman
6,131,638 A 10/2000 Levin
6,179,513 B1 1/2001 Marasco
7,281,560 B2 * 10/2007 Hicks et al. ..... 160/80

* cited by examiner

*Primary Examiner*—Katherine W Mitchell
*Assistant Examiner*—Jeremy C Ramsey
(74) *Attorney, Agent, or Firm*—Pearne & Gordon LLP

(57) ABSTRACT

A retractable awning is provided, comprising a support arm forming a longitudinally extending channel, a roller, and a canopy configured to be rolled and unrolled about the roller. A rafter arm is operatively attached to the support arm and is sized to be longitudinally nestable in the channel of the support arm. A self-engaging and self-releasing locking device includes an engagement device configured to selectively engage the support arm to selectively lock a position of a slide member within the longitudinally extending channel. In addition or alternatively, the retractable awning can include a pair of support mechanisms, each support mechanism comprising a support arm, a rafter arm, and a locking device. In addition or alternatively, the retractable awning can include a control link configured to selectively disengage the engagement device from the support arm to release the position of the slide member within the longitudinally extending channel.

23 Claims, 6 Drawing Sheets

SELF-ACTUATED, SELF-RELEASE RAFTER LOCK MECHANISM

FIELD OF THE INVENTION

The present invention relates generally to a retractable awning, and more particularly, to a retractable awning having a self-engaging, self-releasing locking device.

BACKGROUND OF THE INVENTION

Roll-style fabric awnings, so-called "roll awnings," are commonly provided on recreational vehicles, travel trailers, mobile homes, and the like, and are also usable with fixed structures such as, for example, buildings. Such awnings generally consist of a rotating roller having a sheet of awning fabric or canopy attached and wound thereon. The awning is kept fully rolled up on the roller while the vehicle is configured for traveling. The roller is supported at its ends by support arms for movement between a retracted or stowed position, wherein the roller is disposed adjacent the-wall, and an extended or deployed position, wherein the roller is extended out away from the wall. Once the awning is extended, it is commonly known in the art to lock the support arms using any number of manually-actuated means, such as locks, clasps, straps, adjustment knobs, and the like. However, some users, such as young users, elderly users, or handicapped users may experience difficulty in using manually-actuated locking mechanisms. Thus, there is a need for an improved self-engaging locking mechanism that can avoid these problems.

BRIEF SUMMARY OF THE INVENTION

The following presents a simplified summary of the invention in order to provide a basic understanding of some aspects of the invention. This summary is not an extensive overview of the invention. It is intended to identify neither key nor critical elements of the invention nor delineate the scope of the invention. Its sole purpose is to present some concepts of the invention in a simplified form as a prelude to the more detailed description that is presented later.

In accordance with an aspect of the present invention, a retractable awning is provided, comprising a support arm forming a longitudinally extending channel, a roller rotatably attached to the support arm, and a canopy configured to be rolled and unrolled about the roller. A rafter arm is operatively attached to the support arm and sized to be longitudinally nestable in the channel of the support arm. A self-engaging and self-releasing locking device includes a slide member configured to slidably engage the longitudinally extending channel and an engagement device configured to selectively engage the support arm to selectively lock a position of the slide member within the longitudinally extending channel.

In accordance with a further aspect of the present invention, a retractable awning is provided comprising a roller, a canopy configured to be rolled and unrolled about the roller, and a pair of support mechanisms. Each support mechanism comprises a support arm forming a longitudinally extending channel, wherein the roller is rotatably attached to the support arm, and a rafter arm operatively attached to the support arm and sized to be longitudinally nestable in the channel of the support arm. Each support mechanism further comprises a locking device including a slide member configured to slidably engage the longitudinally extending channel, an engagement device configured to selectively engage the support arm to selectively lock a position of the slide member within the longitudinally extending channel, and a control link pivotally attached to the slide member and to the rafter arm. The control link is configured to selectively disengage the engagement device from the support arm to release the position of the slide member within the longitudinally extending channel.

In accordance with a further aspect of the present invention, a retractable awning is provided comprising a roller, a canopy configured to be rolled and unrolled about the roller, and a pair of support mechanisms. Each support mechanism comprises a support arm forming a longitudinally extending channel, wherein the support arms have one end supporting the canopy and another end contacting a supporting surface, a rafter arm operatively attached to the support arm and sized to be longitudinally nestable in the channel of the support arm, and a locking device. The locking device comprises a slide member configured to slidably engage the longitudinally extending channel, and an engagement device configured to selectively engage the support arm to selectively lock a position of the slide member within the longitudinally extending channel. The engagement device further comprises a resilient portion. The locking device further comprises a control link pivotally attached to the slide member and to the rafter arm, wherein the control link is configured to selectively disengage the engagement device from the support arm to release the position of the slide member within the longitudinally extending channel. The control link is further adapted to engage the resilient portion of the engagement device to inhibit vibration of the rafter arm when the rafter arm is nested within the support arm.

In accordance with a further aspect of the present invention, a retractable awning is mounted on a side of a recreational vehicle, the awning comprising a canopy, a roller attached to the canopy and about which the canopy can be rolled and unrolled, and a pair of channel-shaped support arms having a main wall and a pair of sidewalls which in combination define a longitudinally extending channel. Each sidewall has a pair of flanges defining a groove therebetween, and the support arms have one end supporting the canopy and another end contacting a supporting surface. Each of the support arms further comprises at least one aperture. The awning further comprises a pair of tension rafters having one end operatively secured to the side of the recreational vehicle and another end operatively attached to an associated one of the support arms, whereby each of the tension rafters is sized to be nestable in the channel of the associated support arm. The awning further comprises a slide member comprising a pair of outwardly extending tongues adapted to slidably engage the grooves of the support arms such that the slide member is movable relative to the associated support arm, the slide member including a engagement device having a member adapted to engage the at least one aperture of the associated support arm. The awning further comprises a control link pivotally attached to the slide member and to the tension rafter, wherein the control link is capable of disengaging the engagement device from the at least one aperture of the associated support arm.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
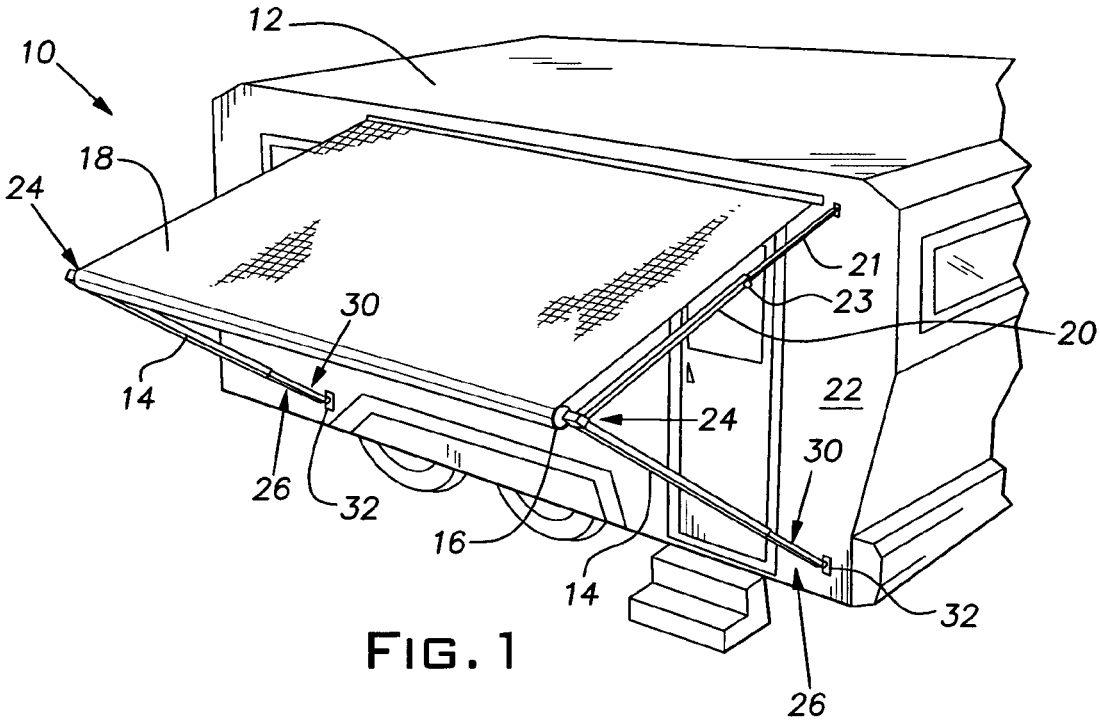
FIG. 1 is a perspective view of a recreational vehicle having an example retractable awning incorporating an aspect of the present invention.

An example embodiment of a device that incorporates the present invention is shown in the drawings. It is to be appreciated that the shown example is not intended to be a limitation on the present invention. Specifically, the present invention can be utilized in other embodiments and even other types of devices.

Turning to the example shown in FIG. 1, a retractable awning 10 is shown in a deployed position attached to the side of a recreational vehicle 12. It is to be appreciated that the retractable awning 10 may be attached to any structure having a substantially vertical surface, such as travel trailers, mobile homes, and the like, may also be used with fixed structures, such as a buildings. The retractable awning 10 further includes a support arm 14 supporting a roller 16. The roller 16 has a canopy 18 attached thereto configured to be rolled and unrolled about the roller 16. The canopy 18 is of the type well known in the art adapted to protect a user from the elements, such as the sun, rain, etc. A rafter arm 20 can be operatively attached to the support arm 14 and can also support the roller 16. Although the roller 16 is shown rotatably attached to the support arms 14, this is not intended to present a limitation on the present invention. For example, the roller 16 could be rotatably attached to the side 22 of the recreational vehicle 12, and an end of the canopy 18 could be supported by the support arms 14.

The retractable awning 10 can further include a self-engaging and self-releasing locking device 24 engaged with the support arm 14. In the shown example, the retractable awning 10 includes a pair of support arms 14 and rafter arms 20 attached to a vertical surface 22 of the recreational vehicle 12, and a pair of locking devices 24 engaged with the support arms 14. As shown, the support arms 14 and rafter arms 20 are pivotally attached to the recreational vehicle 12. It is to be appreciated that the support arms 14 and rafter arms 20 may be attached to the recreational vehicle 12 in any manner.

Figure 2A:
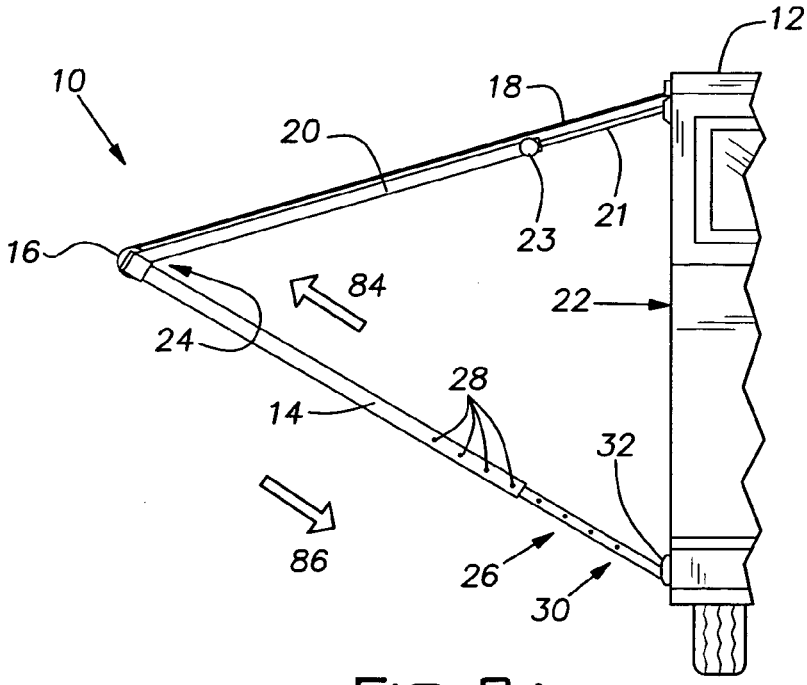
FIG. 2*a* is a side view of the example awning of FIG. 1 showing the awning in a deployed position and supported by the recreational vehicle.
Figure 2B:
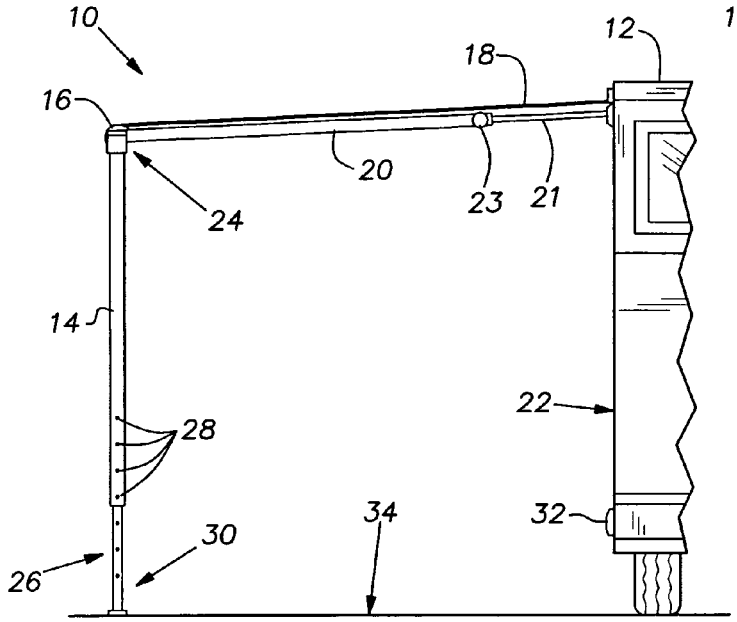
FIG. 2*b* is similar to FIG. 2*a*, but shows the awning supported by the ground.
Figure 3:
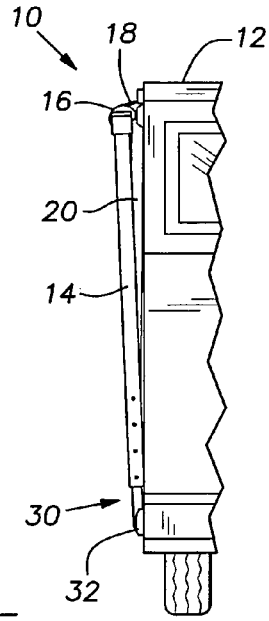
FIG. 3 is a side view of the example awning of FIG. 1 showing the awning in a stowed position.

Turning to the example shown in FIG. 2*a*, the retractable awning 10 is shown in a deployed position such that the roller 16 and canopy 18 extend away from the recreational vehicle 12. Each rafter arm 20 is associated with a support arm 14 and can be adapted to be slidably moved along the length of an associated support arm 14 for moving the awning 10 between the deployed positions shown in FIGS. 2*a* and 2*b*, and a stowed position as shown in FIG. 3. Each rafter arm 20 may help to maintain tension in the canopy 18 when the awning 10 is in the deployed position. Further, as shown, the rafter arms 20 may include an extensible portion 21 so as to be extendable along their lengths. It is to be appreciated that either the rafter arm 20 or the extensible portion 21 can be attached to the side of the recreational vehicle 12. Alternatively, the rafter arms 20 may also comprise a single, solid element.

Where the rafter arms 20 include an extensible portion 21, they may also include a retaining device 23 configured to retain the position of the extensible portion 21 relative to the rafter arm 20. The retaining device 23 can be disposed on either the rafter arm 20 or the extensible portion 21, and can be used to maintain tension within the canopy 18 when the rafter arms 20 are in the extended position. The retaining device 23 can comprise various types, such as a friction lock (see FIGS. 1-2B), a locking cam device, and/or a pin or ratcheting device adapted to be received by corresponding holes (not shown) in the rafter arms 20 and/or extensible portions 21. The retaining device 23 can also be manually or automatically actuated, and can include associated structure (e.g., knobs, handles, push buttons, springs, etc.) for actuation thereof. It is to be appreciated that various devices capable of selectively retaining the extensible portion 21 relative to the rafter arm 20 at a desired length may be used.

Further, one end 30 of the support arm 14 can be in contact with a supporting surface. In the example shown in FIG. 2*a*, the end 30 is releasably attached to and supported by a bracket 32 attached to the vertical sidewall 22 of the recreational vehicle 12. In another example, the supporting surface can include a support rail (not shown) attached to the wall 22 of the recreational vehicle 12. In yet another example, as shown in FIG. 2*b*, the support arm 14 is also capable of being supported by the ground 34. In order to be supported by the ground 34, it may be necessary to extend the length of the support arm 14. Thus, each support arm 14 includes an extensible portion 26 so as to be extendable along their lengths. In the shown example, the support arm 14 includes a plurality of holes 28 adapted to engage a lock component (not shown) to selectively lock the support arm 14 at a desired length. For example, the lock component could comprise a pin or ratcheting device adapted to be received by the holes 28. It is to be appreciated that any device capable of selectively locking the extensible portion 26 at a desired length may be used.

Figure 4:
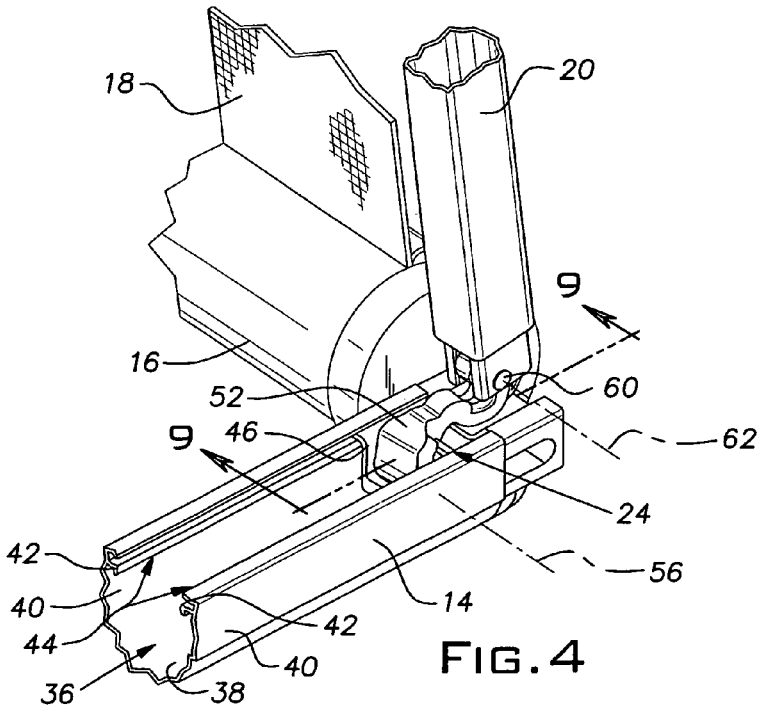
FIG. 4 is a perspective view of an example locking device attached to a support arm of the awning shown in a deployed position.

Turning now to the example shown in FIG. 4, the support arm 14 and rafter arm 20 are shown in the deployed position. The support arm 14 forms a longitudinally extending channel 36. The support arm 14 includes a main wall 38 and a pair of sidewalls 40 which in combination form the longitudinally extending channel 36. Each channel 36 includes structure configured to slidably engage the locking device 24. In the shown example, each sidewall 40 includes a pair of flanges 42 defining a groove 44 therebetween. The rafter arm 20 can be sized to be longitudinally nestable in the channel 36 of the support arm 14 when the awning 10 is in the stowed position (see FIGS. 3 and 8).

Figure 5:
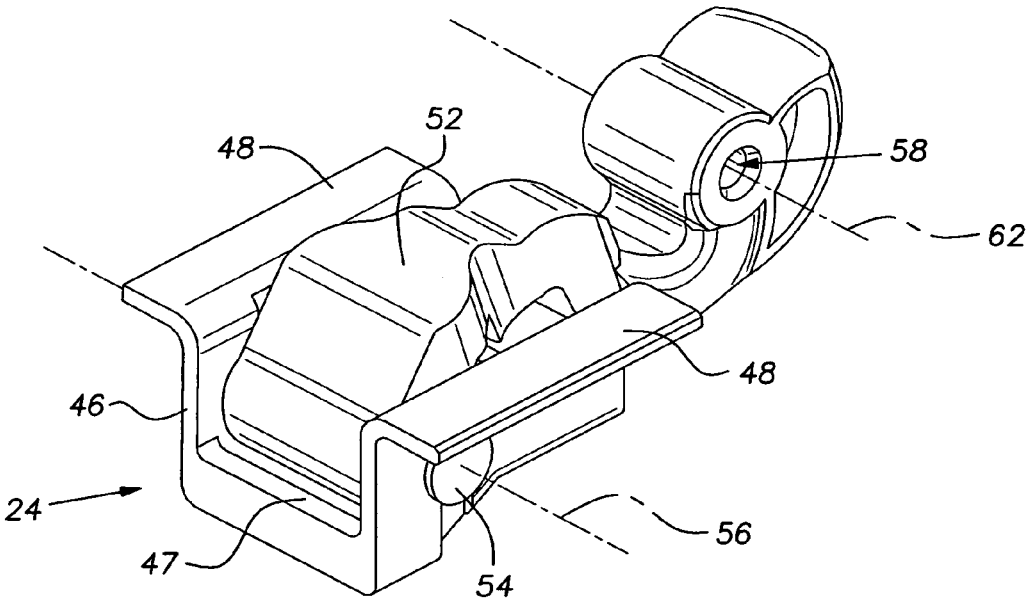
FIG. 5 is a perspective view of the example locking device of FIG. 4.

The locking device 24 can be adapted to selectively lock the position of the rafter arm 20 relative to the support arm 14. Turning now to the example shown in FIG. 5, the locking device 24 includes a slide member 46 configured to slidably engage the longitudinally extending channel 36. In the shown example, the slide member 46 includes a pair of outwardly extending tongues 48 adapted to slidably engage the grooves 44 of the support arms 14. Thus, the slide member 46 can be movable relative to the support arm 14 along the channel 36.

The locking device 24 can further include a control link 52 pivotally attached to the slide member 46 and to the rafter arm 20. In the shown example, the slide member 46 includes a shaft 54 extending therethrough about which the control link 52 is pivotable. Thus, as shown, the control link 52 can be pivotable about a first axis 56 that is transverse to the longitudinally extending channel 36. The control link 52 can also be pivotally attached to the rafter arm 20. For example, the control link 52 may include a hole 58 to permit a shaft 60 to extend therethrough (see FIG. 4). Thus, as shown, the control link 52 can also be pivotable about a second axis 62 that is transverse to the longitudinally extending channel 36. It is to be appreciated that the control link 52 may be pivotally attached to the slide member 46 and to the rafter am 20 using any pivotable connection, such as, for example, a pin, rod, or the like. It is to be appreciated that the example control link 52, as shown in the various figures, is not intended to present a limitation upon the present invention and that any control link 52 having any geometry may be used.

Figure 9:
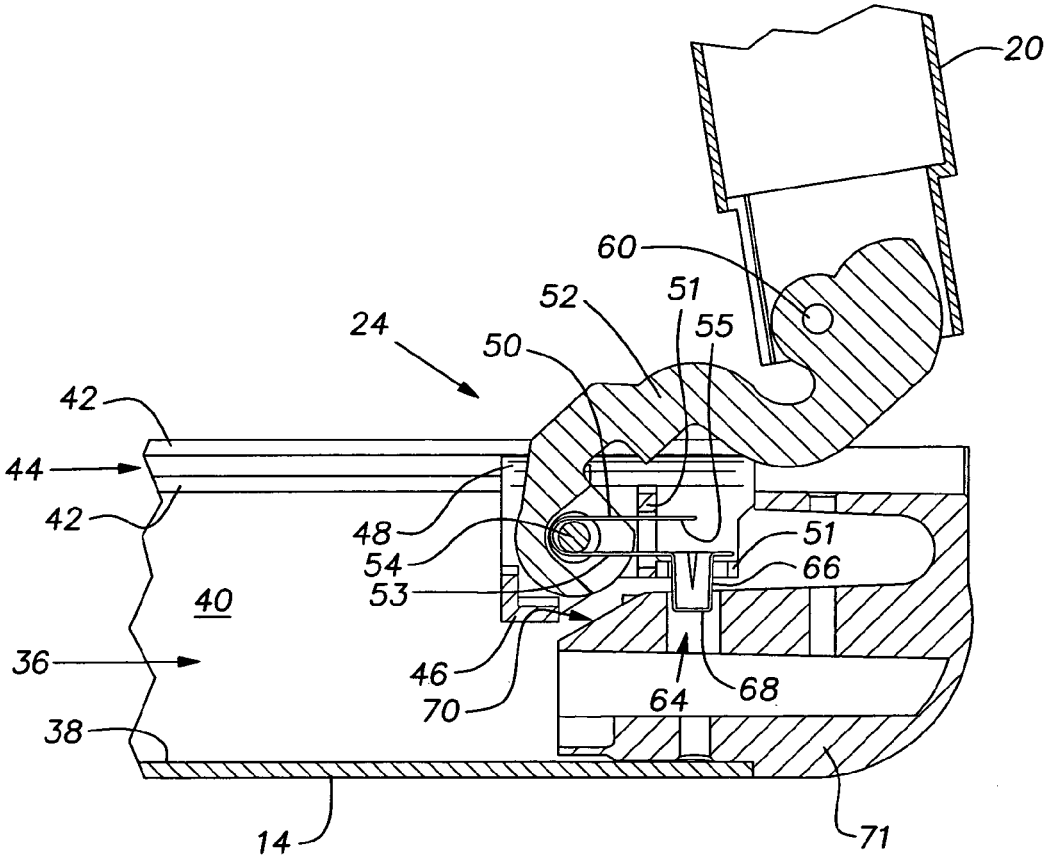
FIG. 9 is a sectional view of the example locking device along line 9-9 of FIG. 4.

Turning now to the example shown in FIG. 9, the locking device 24 can further include an engagement device 50. The engagement device 50 can be configured to selectively engage the support arm 14, as will be further described below, to selectively lock a position of the slide member 46 within the longitudinally extending channel 36. The control link 52 can be configured to selectively disengage the engagement device 50 from the support arm 14 to release the position of the slide member 46 within the longitudinally extending channel 36.

The engagement device 50 can include a resilient material. For example, the engagement device 50 may include a spring clip, or the like, made of a spring steel. The engagement device 50 can also include a first resilient portion 53 and a second resilient portion 55. The slide member 46 can include at least one retainer element 51 adapted to retain at least a portion of the engagement member 50 and to provide a surface against which the resilient material of the engagement device 50 can act. Further, the engagement device 50 can include a member 66 having a protrusion 68, and the support arm 14 can include an aperture 64 adapted to receive the protrusion 68. In the shown example, both of the first and second resilient portions 53, 55 are retained by retainer elements 51 to thereby cause the first resilient portion 53 to be resiliently biased to engage the aperture 64 of the support arm 14. Thus, in the shown example, the slide member 46 can be locked to the support arm 14 when the protrusion 68 of the member 66 is received in the aperture 64. The protrusion 68 can be maintained within the aperture 63 by the resilient biasing force of the engagement device 50 to selectively lock a position of the slide member 46 within the longitudinally extending channel 36.

Remaining with FIG. 9, the support arm 14 can also include a ramped portion 70 adapted to drive the engagement device 50. The ramped portion 70 can be formed as part of the support arm 14, or alternatively, the ramped portion 70 can be attached to the support arm 14. For example, as shown, the ramped portion 70 can be included as a portion of an end cap 71 attached to the end of the support arm 14. The end cap 71 can be either removably or fixedly attached to the support arm 14 using any suitable attachment method.

In the shown example, the ramped portion 70 is disposed below the engagement device 50 and adjacent to the aperture 64. Thus, when the locking device 24 is moving towards the aperture 64 (e.g., in the direction of arrow 84 of FIG. 2*a*), the ramped portion 70 of the support arm 14 will engage the protrusion 68 of the engagement device 50 to drive the protrusion 68 towards the aperture 64. For example, the ramped portion 70 can be adapted to drive the protrusion 68 towards the aperture 64 when the tension rafter 20 is in a fully extended position. As such, the retractable awning 10 exhibits a self-engaging and/or self-actuating locking feature. Additionally, once the tension rafter 20 is in a fully extended position (or other desired position), the retaining device 23 can be manually or automatically actuated to retain the position of the extensible portion 21.

Figure 6:
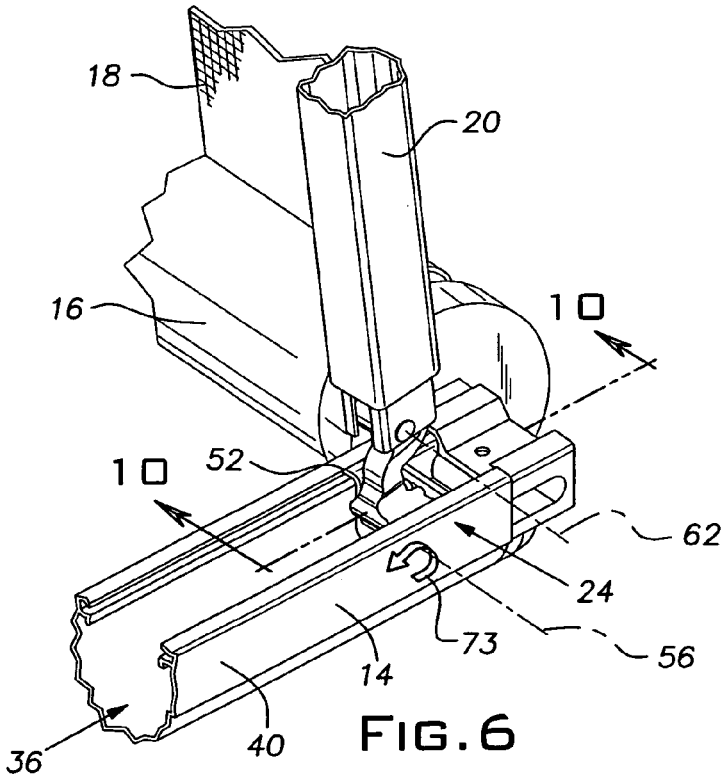
FIG. 6 is similar to FIG. 4, but shows the locking device being unlocked.

Turning now to the example shown in FIG. 6, the control link 52 can be adapted to selectively disengage the engagement device 50 from the aperture 64 of the support arm 14. During the stowing process, for example, the control link 52 can be adapted to naturally pivot in the direction of arrow 73. Generally, the retractable awning 10 can be resiliently biased towards the stowed position. Thus, the retractable awning 10 can be held in tension when it is in the deployed position. The tension can be created by the rafter arms 20, the retaining device 23, the canopy 18, and/or at least one resilient biasing member (not shown), such as, for example, a torsion spring disposed within the roll tube 16. To initiate the stowing process, a user can manually or automatically actuate the retaining device 23 to permit the extensible portion 21 to be released from the rafter arm 20 and to retract therein. Once the stowing process is initiated, the tension can cause the control link 52 to naturally pivot in the direction of arrow 73 to thereby cause the protrusion 68 to be disengaged from the aperture 64. As such, the retractable awning 10 exhibits a self-releasing locking feature.

Figure 10:
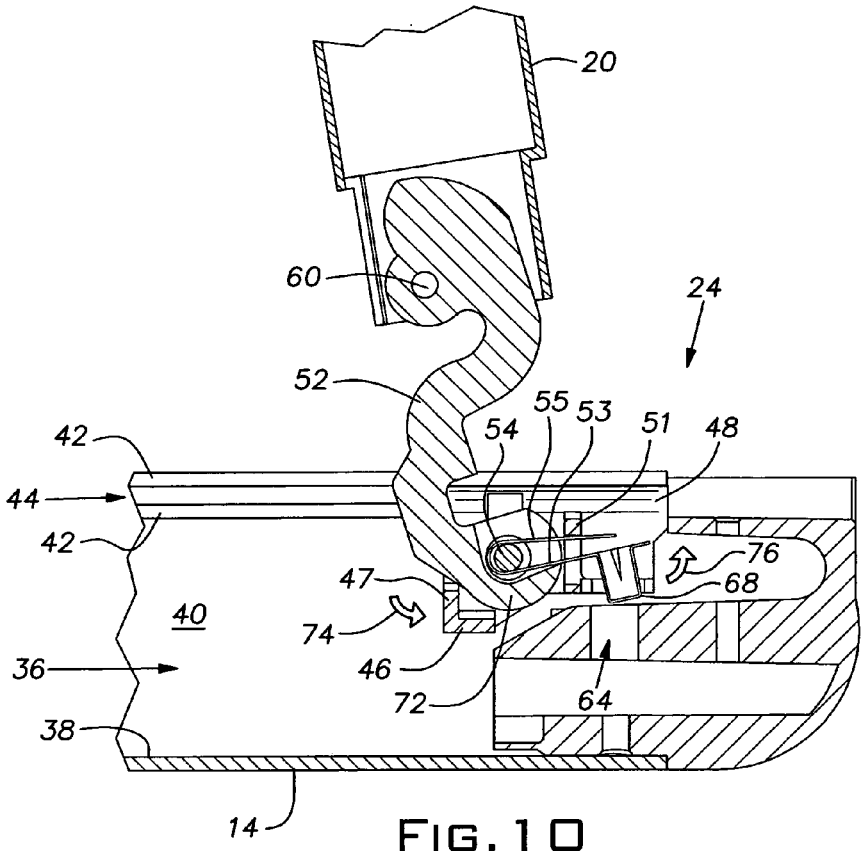
FIG. 10 is a sectional view of the example locking device along line 10-10 of FIG. 6.

Turning now to the example shown in FIG. 10, the engagement device 50 can be disengaged from the aperture 64 in the following manner. The control link can include a first element 72 that can be adapted to engage the first resilient portion 53 of the engagement device 50. Further, as shown, the control link 52 can be adapted to pivot about the shaft 54 and relative to the slide member 46. Thus, when the control link 52 is pivoted relative to the slide member 46 in the direction of arrow 74, the first element 72 will engage the first resilient portion 53 of the engagement device 50 to cause the first resilient portion 53 to be lifted in an upward vertical direction as shown by arrow 76. As such, the protrusion 68 will thereby be disengaged from the aperture 64, and will remain so disengaged while the control link 52 is maintained in the pivoted position as shown in FIG. 10. The slide member 46 can further include a stop portion 47 adapted to control the range of motion of the control link 52 and the attached rafter arm 20. Of course, once the protrusion 68 is disengaged from the aperture 64, and the slide member 46 is moved away from the aperture 64 (e.g., in the direction of arrow 86 of FIG. 2*a*), the control link 52 will no longer be required to be engaged with the first resilient portion 53 of the engagement device 50.

Figure 7:
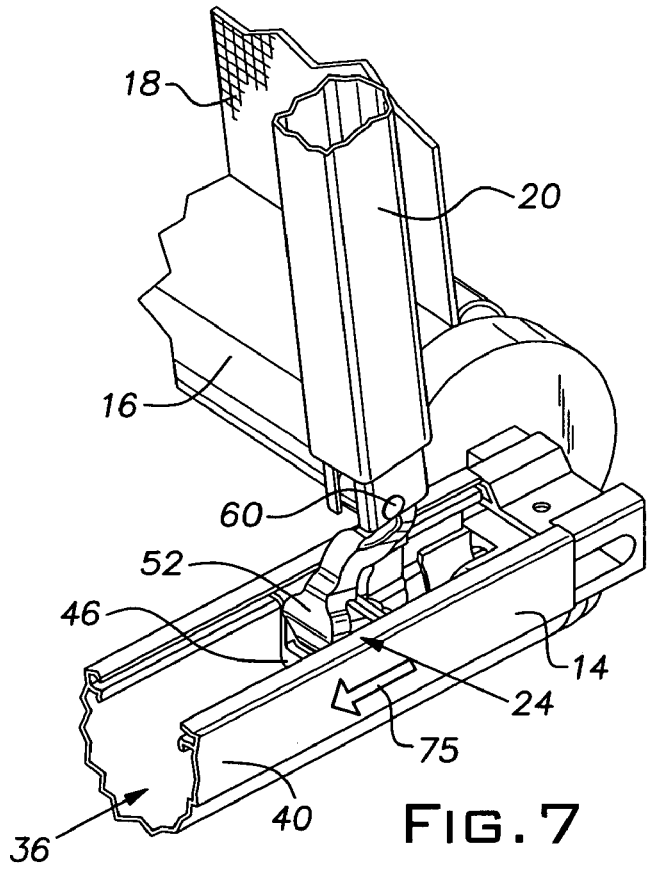
FIG. 7 is similar to FIG. 6, but shows movement of the support arm after the locking device has been unlocked.
Figure 8:
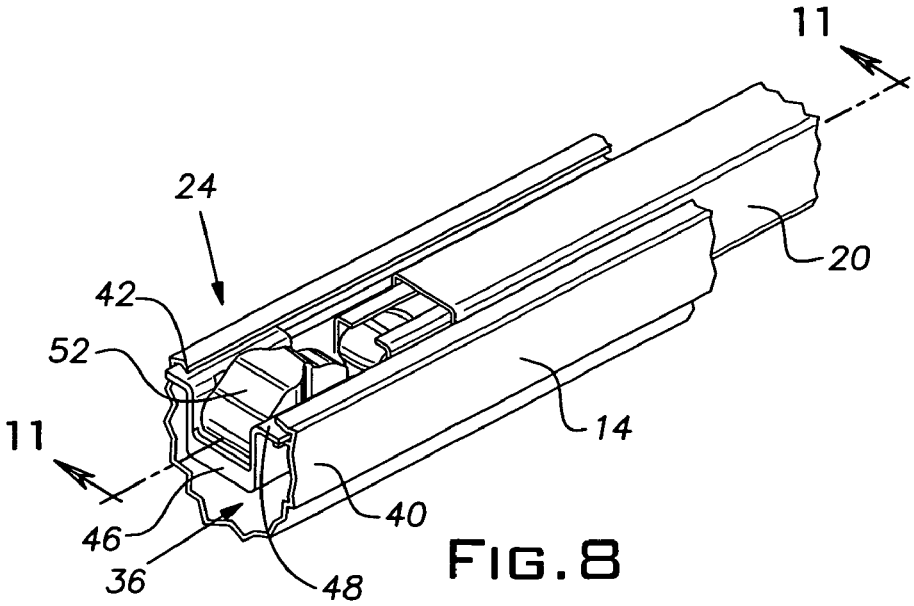
FIG. 8 is similar to FIG. 7, but shows the support arm in a stowed position.

After the engagement device 52 can be disengaged from the aperture 64, as describe above, the retractable awning 10 then proceeds through the remainder of the stowing process, as shown in FIGS. 7 and 8. The slide member 46 slides within the longitudinally extending channel 36 in the generally downward direction of arrow 75 (also shown as arrow 86 in FIG. 2*a*). The slide member 46 continues to slide within the channel longitudinally extending 36 until the rafter arm 20 is nested substantially within the support arm 14, as shown in FIG. 8, and the retractable awning 10 reaches the stowed position, as shown in FIG. 3. During the stowing process, the control link 52 can pivot relative to the slide member 46 about shaft 54, and the rafter arm 20 can correspondingly pivot about the shaft 60.

Figure 11:
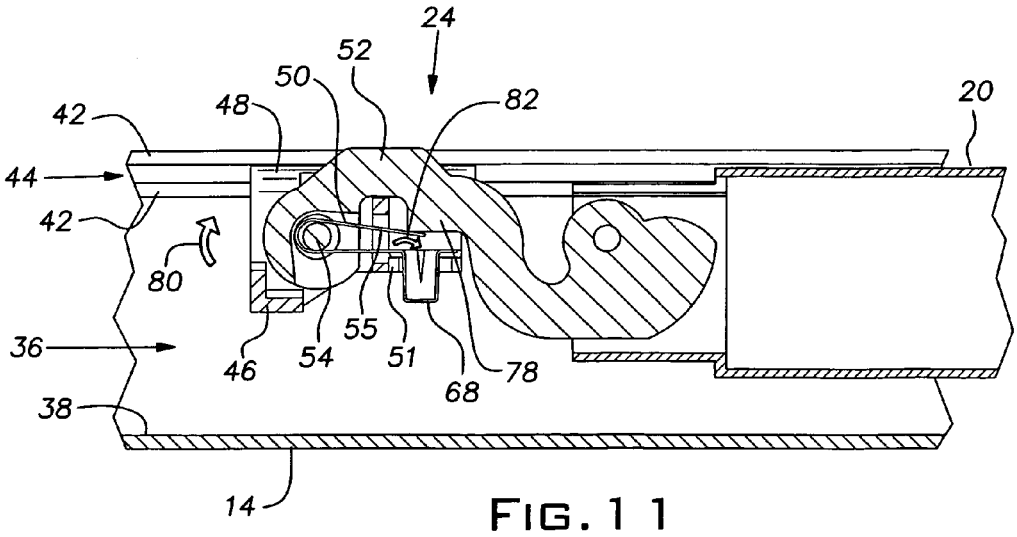
FIG. 11 is a sectional view of the example locking device along line 11-11 of FIG. 8.

Turning now to the example shown in FIG. 11, the control link 52 can also be adapted to engage the engagement device 50 to inhibit vibration of the rafter arm 20 when the awning 10 is in the stowed position (see FIGS. 3 and 8). For example, the control link 52 can be adapted to apply a pre-load force to the second resilient portion 55 of the engagement device 50 when the rafter arm 20 is nested within the channel 36 of the support arm 14. The control link can include a second element 78 that can be adapted to engage the second resilient portion 55 of the engagement device 50. Thus, as shown, when the rafter arm 20 is nested within the support arm 14 and the control link 52 is pivoted relative to the slide member 46 in the direction of arrow 80, the second element 78 will engage the second resilient portion 55 of the engagement device 50 to cause the second resilient portion 55 to be pushed in a downward vertical direction as shown by arrow 82. The counter-acting force of the second resilient portion 55 provides the pre-load force to the rafter arm 20 to inhibit vibration when the awning 10 is in the stowed position.

In operation, the retractable awning 10 begins in the stowed position shown in FIGS. 3 and 8. To deploy the rafter arm 20 and the canopy 18, the slide member 46 of the locking device 24 slides within the longitudinally extending channel 36 in a generally upward direction as shown by arrow 84 (FIG. 2*a*). As the slide member 47 reaches the end of the support member 14, the protrusion 68 of the engagement device 50 engages the ramped portion 70 of the support arm 14. In combination with the ramped portion 70, the upward movement of the locking device 24 drives the protrusion 68 towards the aperture 64, until the protrusion 68 is received within the aperture 64. The first resilient portion 53 of the engagement device 50 maintains the protrusion 68 within the aperture 64 to lock the awning 10 in the deployed position as shown in FIGS. 2*a*, 2*b* and 4. When it is desired to return the awning 10 to the stowed position, the control link 52 is pivoted as shown in FIGS. 6 and 10 to cause the first element 72 to engage the first resilient portion 53 to thereby disengage the protrusion 68 from the aperture 64. The slide member 46 slides within the longitudinally extending channel 36 in the generally downward direction of arrow 86 (FIG. 2*a*). Once the rafter arm 20 is nested within the support arm 14, the control link 52 is pivoted in the direction of arrow 80 such that the second element 78 engages the second resilient portion 55 of the engagement device 50. Thus, the pre-load force applied by the second resilient portion 55 acts to inhibit vibration of the rafter arm 20 while it is in the stowed position. Though a particular method of operation has been described, fewer or additional steps may also be performed to deploy, stow, lock and/or unlock the retractable awning 10.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

What is claimed is:

1. A retractable awning, comprising:

a support arm forming a longitudinally extending channel;

a roller rotatably attached to the support arm;

a canopy configured to be rolled and unrolled about the roller;

a rafter arm operatively attached to the support arm and sized to be longitudinally nestable in the channel of the support arm;

a self-engaging and self-releasing locking device including a slide member configured to slidably engage the longitudinally extending channel and an engagement device configured to selectively engage the support arm to selectively lock a position of the slide member within the longitudinally extending channel; and a control link pivotally attached to the slide member and to the rafter arm, and adapted to selectively engage the engagement device;

wherein actuation of rafter arm or a device remote from the locking device causes the locking device to release.

2. The retractable awning as set forth in claim 1, wherein the engagement device includes a resilient material.

3. The retractable awning as set forth in claim 2, wherein the support arm comprises an aperture and the engagement device is resiliently biased to engage the aperture to selectively lock a position of the slide member within the longitudinally extending channel.

4. The retractable awning as set forth in claim 3, wherein the support arm comprises a ramped portion adapted to drive the engagement device.

5. The retractable awning as set forth in claim 4, wherein the control link is configured to selectively disengage the engagement device from the support arm to release the position of the slide member within the longitudinally extending channel.

6. The retractable awning as set forth in claim 5, wherein the control link is adapted to selectively disengage the engagement device from the aperture of the support arm.

7. The retractable awning as set forth in claim 5, wherein the control link is adapted to pivot relative to the slide member to selectively disengage the engagement device from the aperture and carry the locking device within the longitudinally extending channel.

8. The retractable awning as set forth in claim 5, wherein the engagement device comprises at least one resilient portion and a protrusion configured to engage with the aperture.

9. The retractable awning as set forth in claim 8, wherein the control link is adapted to engage the resilient portion to disengage the protrusion from the at least one aperture.

10. The retractable awning as set forth in claim 8, wherein the control link is adapted to engage the resilient portion of the engagement device when the rafter arm is nested in the channel of the support arm.

11. The retractable awning as set forth in claim 1, the support arm comprising an extensible portion adapted to adjust the length of the support arm.

12. A retractable awning comprising a roller, a canopy configured to be rolled and unrolled about the roller, and a pair of support mechanisms, each support mechanism comprising:

a support arm forming a longitudinally extending channel, wherein the roller is rotatably attached to the support arm;

a rafter arm operatively attached to the support arm and sized to be longitudinally nestable in the channel of the support arm; and a locking device including a slide member configured to slidably engage the longitudinally extending channel, an engagement device configured to selectively engage the support arm to selectively lock a position of the slide member within the longitudinally extending channel, and a control link separately, pivotally attached to the slide member and to the rafter arm about separate axes, wherein the control link is configured to selectively disengage the engagement device from the support arm to release the position of the slide member within the longitudinally extending channel.

13. A retractable awning comprising a roller, a canopy configured to be rolled and unrolled about the roller, and a pair of support mechanisms, each support mechanism comprising a support arm forming a longitudinally extending channel, wherein the support arms have one end supporting the canopy and another end contacting a supporting surface, a rafter arm operatively attached to the support arm and sized to be longitudinally nestable in the channel of the support arm, and a locking device, the locking device comprising:

a slide member configured to slidably engage the longitudinally extending channel;

an engagement device configured to selectively engage the support arm to selectively lock a position of the slide member within the longitudinally extending channel, the engagement device further comprising a resilient portion; and a control link separately, pivotally attached to the slide member and to the rafter arm about separate axes, wherein the control link is configured to selectively disengage the engagement device from the support arm to release the position of the slide member within the longitudinally extending channel, the control link further adapted to engage the resilient portion of the engagement device to inhibit vibration of the rafter arm when the rafter arm is nested within the support arm.

14. The retractable awning of claim 13, wherein the roller is rotatably attached to the supporting surface and the support arms are adapted to support an end of the canopy when the awning is in a deployed position.

15. A retractable awning mounted on a side of a recreational vehicle, the awning comprising:

a canopy;

a roller attached to the canopy and about which the canopy can be rolled and unrolled;

a pair of channel-shaped support arms having a main wall and a pair of sidewalls which in combination define a longitudinally extending channel, each sidewall having a pair of flanges defining a groove therebetween, the support arms having one end supporting the canopy and another end contacting a supporting surface, each of the support arms further comprising at least one aperture;

a pair of tension rafters having one end operatively secured to the side of the recreational vehicle and another end operatively attached to an associated one of the support arms, whereby each of the tension rafters is sized to be nestable in the channel of the associated support arm;

a slide member comprising a pair of outwardly extending tongues adapted to slidably engage the grooves of the support arms such that the slide member is movable relative to the associated support arm, the slide member including a engagement device having a member adapted to engage the at least one aperture of the associated support arm; and a control link pivotally attached to the slide member and to the tension rafter, wherein the control link is capable of disengaging the engagement device from the at least one aperture of the associated support arm; wherein activation of the tension rafter or a device remote from the engagement device causes the engagement device to release.

16. The retractable awning as set forth in claim 15, the support arms each comprising a ramped portion adapted to drive the member of the slide member towards the aperture of the support arms when the tension rafters are in a fully extended position.

17. The retractable awning as set forth in claim 15, wherein the engagement device is made from a resilient material, and the member is resiliently biased to engage the aperture of the support arm to releasably secure the tension rafter thereto.

18. The retractable awning as set forth in claim 17, the slide member comprising a shaft extending therethrough and about which the control link is pivotable, and the control link comprising a first element adapted to engage the engagement device, wherein pivoting of the control link about the shaft causes the first element to disengage the member from the at least one aperture.

19. The retractable awning as set forth in claim 18, the engagement device comprising a first extended portion having the member attached thereto, wherein the first element of the control link is adapted to engage the first extended portion to disengage the member from the at least one aperture.

20. The retractable awning as set forth in claim 19, the engagement device comprising a second extended portion, and the control link comprising a second element adapted to engage the second extended portion of the engagement device when the tension rafter is nested in the channel of the associated support arm.

21. The retractable awning as set forth in claim 15, the support arms comprising an extensible portion adapted to adjust the length of the support arms.

22. The retractable awning as set forth in claim 1, wherein the device remote from the locking device is a rafter lock.

23. A retractable awning, comprising:

a support arm forming a longitudinally extending channel and an aperture;

a roller rotatably attached to the support arm;

a canopy configured to be rolled and unrolled about the roller;

a rafter arm operatively attached to the support arm and sized to be longitudinally nestable in the channel of the support arm;

a self-engaging and self-releasing locking device including a slide member configured to slidably engage the longitudinally extending channel and an engagement device configured to selectively engage the support arm to selectively lock a position of the slide member within the longitudinally extending channel; and a control link pivotally attached to the slide member and to the rafter arm, and adapted to selectively engage the engagement device;

wherein the engagement device includes first and second resilient portions, wherein the control link is adapted to engage the first resilient portion to disengage the engagement device from the support arm and to engage the second resilient portion when the rafter arm is nested in the channel of the support arm.

* * * * *